US005787740A

United States Patent [19]

Huebner

[11] Patent Number: 5,787,740

[45] Date of Patent: Aug. 4, 1998

[54] BOAT LOCKING APPARATUS

[76] Inventor: Jerold R. Huebner, 565 Roast Meat Hill Rd., Killingworth, Conn. 06419

[21] Appl. No.: 918,159

[22] Filed: Aug. 25, 1997

Related U.S. Application Data

[60] Continuation of Ser. No. 522,557, Sep. 1, 1995, abandoned, which is a division of Ser. No. 288,689, Aug. 11, 1994, Pat. No. 5,467,617.

[51] Int. Cl.[6] ..... E05B 69/00

[52] U.S. Cl. ..... 70/58; 70/14; 70/57; 114/39.2

[58] Field of Search ..... 70/57, 58, 423, 70/424, 158, 163, 455; 114/39.2

[56] References Cited

U.S. PATENT DOCUMENTS

| | | | |
|---|---|---|---|
| 3,876,247 | 4/1975 | Hayes, Jr. et al. | 292/202 |
| 4,680,949 | 7/1987 | Stewart | 70/58 |
| 4,924,683 | 5/1990 | Derman | 70/58 |
| 5,268,809 | 12/1993 | Eschenburg | 70/14 |
| 5,381,685 | 1/1995 | Carl et al. | 70/58 |

FOREIGN PATENT DOCUMENTS

| | | | |
|---|---|---|---|
| 3824393 | 7/1989 | Germany | 70/58 |
| 9315295 | 8/1993 | WIPO | 70/58 |

*Primary Examiner*—Steven N. Meyers
*Assistant Examiner*—Tuyet-Phuong Pham

[57] ABSTRACT

A boat locking apparatus is provided for a boat that has a centerboard slot which has a predetermined width and a predetermined height. The boat locking apparatus includes a lock-retaining assembly which includes a first end portion and a second end portion extending distally from the first end portion. A predetermined distance which includes the first and second end portions of the lock-retaining assembly is greater than the predetermined height of the centerboard slot. The lock-retaining assembly has a width which is less than the width of the centerboard slot. A transverse lock assembly is connected to the second end portion of the lock-retaining assembly. The transverse lock assembly is capable of being oriented into two selectable orientations, a non-locking orientation in which the transverse lock assembly is contained within the predetermined width of the slot and a second locking orientation in which the transverse lock assembly cannot be contained within the predetermined width of the centerboard slot.

1 Claim, 5 Drawing Sheets

BOAT LOCKING APPARATUS

RELATED APPLICATION

This application is a continuation of application Ser. No. 08/522,557, filed Sep. 1, 1995, now abandoned which, in turn, is a division of Ser. No. 08/288,689, filed Aug. 11, 1994, now U.S. Pat. No. 5,467,617.

BACKGROUND OF THE INVENTION

1. Field of the Invention

The present invention relates generally to devices for locking boats to prevent unauthorized usage and, more particularly, to a locking device especially adapted for locking a boat having a removable centerboard.

2. Description of the Prior Art

Small boats, such as small sail boats are often susceptible to theft or unauthorized usage when left unguarded at a marina. Many small boats such as row boats and canoes have struts or seats which form an integral part of the boat. With such boats, a cable or chain can be wrapped around the integral struts or seats, and the cable or chain can be secured to a fixed object such as a wall, post, or dock to secure the boat to the wall, post, or dock.

On the other hand, there are other small boats that do not have struts or seats that are integral parts of the boat around which a security cable or chain can be wrapped. For example, many small sail boats are made of molded fiberglass, and the only way to chain or lock the boat is to fasten the boat to a fitting of some sort which is merely screwed into the molded fiberglass. However, a fitting that is secured to a fiberglass portion of a boat is not a very secure means of securing a boat. Screws can easily be unscrewed. Also, a substantial force can be exerted on the fitting, and the screws can be ripped out of the fiberglass. In this respect, it would be desirable if a device were provided for securing a boat to a fixed structure which does not rely upon a fitting secured to a boat with screws screwed into the boat.

There are some boats that employ a centerboard that is placed through a complementary slot in the boat hull when the boat is in use. For example, small sail boats, such as a "sunfish" or a sailing dingy employ a centerboard and a complementary slot in the boat hull. Such small boats are usually small and very portable, and the centerboards are removable when the boats are not in use. When the centerboards are removed from the complementary slot in the boat hull, the slot in the hull is available for receiving a device for securing the boat to a fixed structure. In this respect, it would be desirable if a device were provided for securing a boat to a fixed structure that employs the slot in a boat that is used for receiving a centerboard.

A boat hull has a top side, or deck side, and a bottom side. In this respect, it would be desirable if a device were provided for securing a boat to a fixed structure that can be installed on a boat hull from either the top side or the bottom side of the hull.

Throughout the years, a number of innovations have been developed relating to locks for boats, and the following U.S. patents are representative of some of those innovations: U.S. Pat. Nos. 3,631,896; 3,871,199; 4,418,550; 4,907,522; and 5,215,488. More specifically, U.S. Pat. No. 3,631,896 discloses a complex mechanical lock for either a motor or a fuel tank of a boat. Although such a lock impedes unauthorized use of the boat, such a lock does not secure the boat to a fixed structure. Therefore, such a lock does not prevent the entire boat from being towed away from a fixed structure. In this respect, it would be desirable if a device were provided for securing a boat to a fixed structure.

U.S. Pat. No. 3,871,199 discloses another complex mechanical lock for disabling a boat and therefore making it more difficult for an unauthorized person to use the boat. However, this lock does not prevent the boat from being towed away from a fixed structure. To avoid the complexities of the locks disclosed in U.S. Pat. Nos. 3,631,896 and 3,871,199, and to prevent a boat from being towed away from a fixed structure, it would be desirable if a simple lock were provided for securing a boat to a fixed structure.

U.S. Pat. No. 4,418,550 discloses a boat locking device that employs a plate that fits through a centerboard slot in the boat's hull. A cable or chain is attached to one end of the plate and is used to secure the boat to a fixed structure. Some sort of means are used at the opposite end of the plate to keep the plate from passing through the centerboard slot. Although this device has many desirable features, there is a specific desirable feature that it lacks. To use the device disclosed in the U.S. Pat. No. 4,418,550, the plate must be installed on one side of the hull, and the plate is secured to the fixed structure on the other side of the hull. Such an installation process requires that either the boat must be placed on one side or on its end for installation. Or, the plate must be inserted through the centerboard slot with the boat one side up, the boat must be turned over, and the cable or chain is secured to the plate with the boat in an other-side-up position. Such required installation procedures may be very inconvenient and troublesome. In this respect, it would be desirable if a device were provided for securing a boat to a fixed structure that permitted the device to be installed in a centerboard slot from one side of the boat hull and permitted the boat to be secured to a fixed structure from the same side of the boat hull. Such a desired device would preclude the necessity of either placing the boat on its side, turning the boat from one side to an opposite side, or having to remove the boat from the water for installation of the device.

U.S. Pat. No. 4,907,522 discloses a boat mooring apparatus that employs a cable or chain that engages a fitting attached to the hull of a boat. Disadvantages of using such a fitting are described hereinabove.

U.S. Pat. No. 5,215,488 discloses a locking device for locking a fin to a boat hull. Such a device does not prevent a boat from being towed away from a fixed structure.

Thus, while the foregoing body of prior art indicates it to be well known to use locks for securing boats to fixed structures, the prior art described above does not teach or suggest a boat locking apparatus which has the following combination of desirable features: (1) does not rely upon a fitting secured to a boat with screws; (2) secures a boat to a fixed structure by employing a slot that is integral to the construction of the boat that is used for receiving a centerboard; (3) can be installed on a boat hull from either the top side of the bottom side of the hull; (4) is used for securing a boat to a fixed structure; (5) is simple in structure and operation for securing a boat to a fixed structure; (6) permits the device to be installed in a centerboard slot from one side of the boat hull and permits the boat to be secured to a fixed structure from the same side of the boat hull; and (7) precludes the necessity of placing the boat on its side, turning the boat from one side to an opposite side, or having to remove the boat from the water for installation of the device. The foregoing desired characteristics are provided by the unique boat locking apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a boat locking apparatus for a boat that has a centerboard slot which has a predetermined width and a predetermined height. The boat locking apparatus includes a lock-retaining assembly which includes a first end portion adapted for connecting with a flexible connector, which includes a mid-portion extending distally from the first end portion, and which includes a second end portion that is connected to the mid-portion. A predetermined distance which includes the first end portion, the mid-portion, and the second end portion of the lock-retaining assembly is greater than the predetermined height of the centerboard slot. The lock-retaining assembly has a width which is less than the width of the centerboard slot. A transverse lock assembly is connected to the second end portion of the lock-retaining assembly. The transverse lock assembly capable of being oriented in two selectable orientations. A non-locking orientation in which the transverse lock assembly is oriented such that the transverse lock assembly can be contained within the predetermined width of the centerboard slot and a locking orientation in which the transverse lock assembly cannot be contained with the predetermined width of the centerboard slot.

In accordance with one embodiment of the invention, the transverse lock assembly is comprised of an extensible lock assembly which is connected to the second end portion of the lock-retaining assembly. The extensible lock assembly includes a pair of selectable extensible/retractable members capable of being oriented in two selectable orientations, a retracted orientation in which the extensible/retractable members are oriented along a longitudinal axis extending along the lock-retaining assembly such that the extensible/retractable members extend transversely by a distance less than the width of the centerboard slot and an extended orientation in which the extensible/retractable members are oriented transversely to the longitudinal axis and extend transversely by a distance greater than the width of the centerboard slot.

The extensible lock assembly includes an axle which is connected to the second end portion of the lock-retaining assembly. Extensible/retractable members are connected to the axle, such that the extensible/retractable members are capable of rotating around the axle in moving from a retracted orientation to an extended orientation and vice versa. A ballast assembly is connected to one of the extensible/retractable members for urging the extensible/retractable members to the retracted orientation from the extended orientation.

The second end portion of the lock-retaining assembly includes an assembly connected to the mid-portion. The axle and the extensible/retractable members are supported by the assembly. The extensible/retractable members and the assembly are formed as a unified, one-piece structure.

A lock plate is mounted on the first end portion of the lock-retaining assembly. The lock plate is capable of sliding up and down the first end portion and is capable of engaging a top portion of the centerboard slot. The lock plate includes a transverse portion which straddles the first end portion of the lock-retaining assembly and a descending portion which projects from the transverse portion and which is adapted to enter a top portion of the centerboard slot. The first end portion of the lock-retaining assembly includes a receiving aperture. The first end portion of the lock-retaining assembly includes a stop element which prevents the lock plate from sliding off of the first end portion.

In accordance with another embodiment of the invention, the extensible lock assembly includes a transverse member which is connected to the second end portion of the lock-retaining assembly. The transverse member has a length which is less than the width of the centerboard slot. A pair of extensible/retractable members is connected to the end of the transverse member.

An extensor assembly is connected to the lock-retaining assembly for selectively extending or retracting the extensible/retractable members. The extensor assembly includes a spreader member adapted to urge the extensible/retractable members to an extended, transverse orientation. A shank member is connected to the spreader member, and a handle is connected to the shank member.

In accordance with a third embodiment of the invention, a crank member is connected to the first end portion of the lock-retaining assembly, and a lock plate is mounted on the first end portion of the lock-retaining assembly. The lock plate is capable of sliding up and down the first end portion and the mid-portion and is capable of engaging a top portion of the centerboard slot. The lock plate includes a transverse portion which straddles the first end portion of the lock-retaining assembly. A descending portion of the lock plate projects down from the transverse portion and is adapted to enter a top portion of the centerboard slot. An ascending portion of the lock plate projects upward from the transverse portion. The transverse lock assembly includes a transverse member connected to the second end portion of the lock-retaining assembly. The transverse member has a width which is less than the predetermined width of the centerboard slot. The transverse member has a length which is greater than the predetermined width of the centerboard slot. The transverse member and the crank member are located in parallel planes spaced apart from each other by the lock-retaining assembly and are oriented at right angles to each other.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved boat locking apparatus which has all of the advantages of the prior art and none of the disadvantages.

It is another object of the present invention to provide a new and improved boat locking apparatus which may be easily and efficiently manufactured and marketed.

It is a further object of the present invention to provide a new and improved boat locking apparatus which is of durable and reliable construction.

An even further object of the present invention is to provide a new and improved boat locking apparatus which is susceptible of a low cost of manufacture with regard to both materials and labor, and which accordingly is then susceptible of low prices of sale to the consuming public, thereby making such boat locking apparatus available to the buying public.

Still yet a further object of the present invention is to provide a new and improved boat locking apparatus which does not rely upon a fitting secured to a boat with screws.

Still another object of the present invention is to provide a new and improved boat locking apparatus that secures a boat to a fixed structure by employing a slot that is integral to the construction of the boat that is used for receiving a centerboard.

Yet another object of the present invention is to provide a new and improved boat locking apparatus which can be installed on a boat hull from either the top side or the bottom side of the hull.

Even another object of the present invention is to provide a new and improved boat locking apparatus that is used for securing a boat to a structure.

Still a further object of the present invention is to provide a new and improved boat locking apparatus which is simple in structure and operation for securing a boat to a fixed structure.

Yet another object of the present invention is to provide a new and improved boat locking apparatus that permits the device to be installed in a centerboard slot from one side of the boat hull and permits the boat to be secured to a fixed structure from the same side of the boat hull.

Still another object of the present invention is to provide a new and improved boat locking apparatus which precludes the necessity of either placing the boat on its side, tuning the boat from one side to an opposite side, or having to remove the boat from the water for installation of the device.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
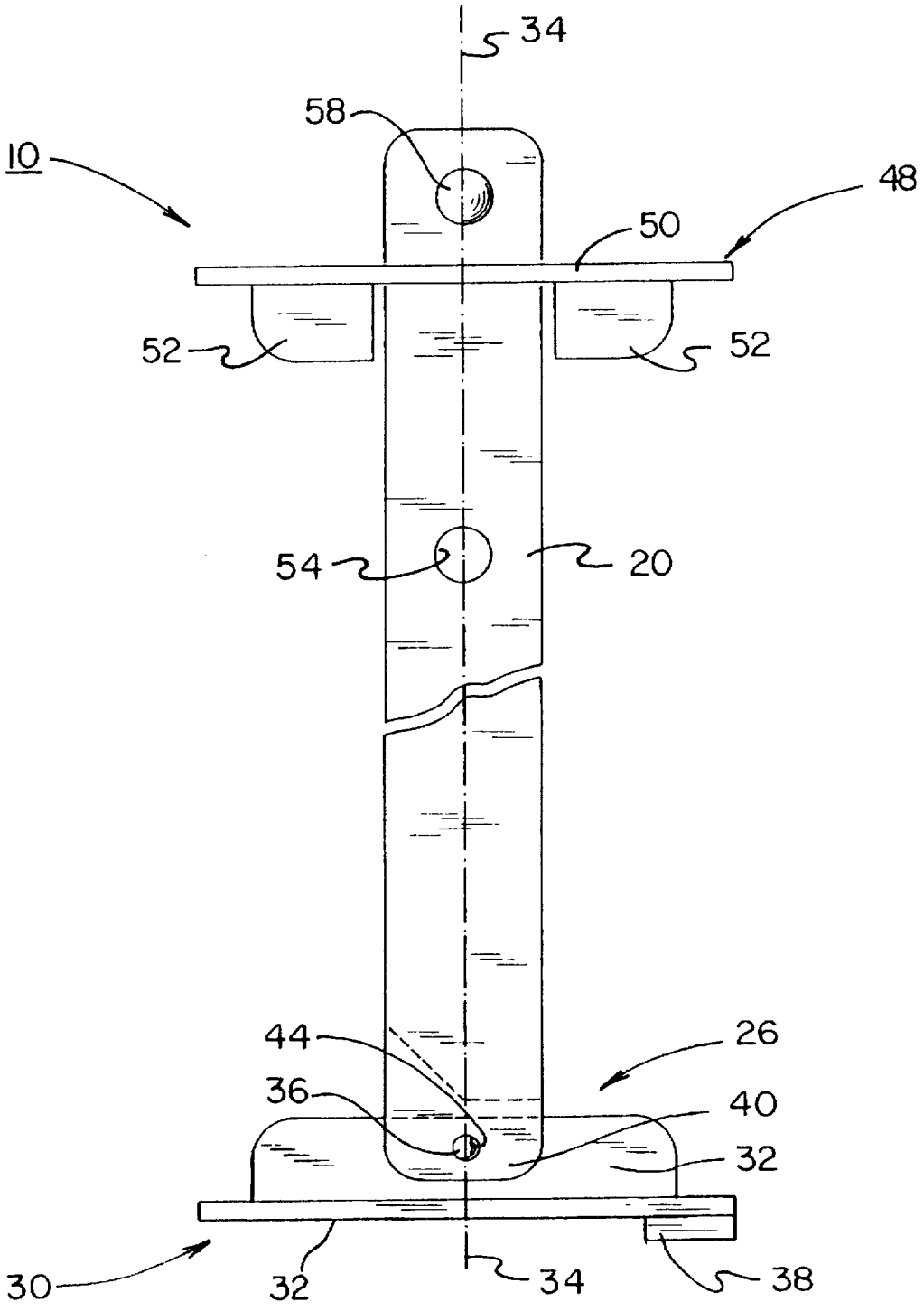
FIG. 1 is a front view of a first preferred embodiment of the boat locking apparatus of the invention.
Figure 2:
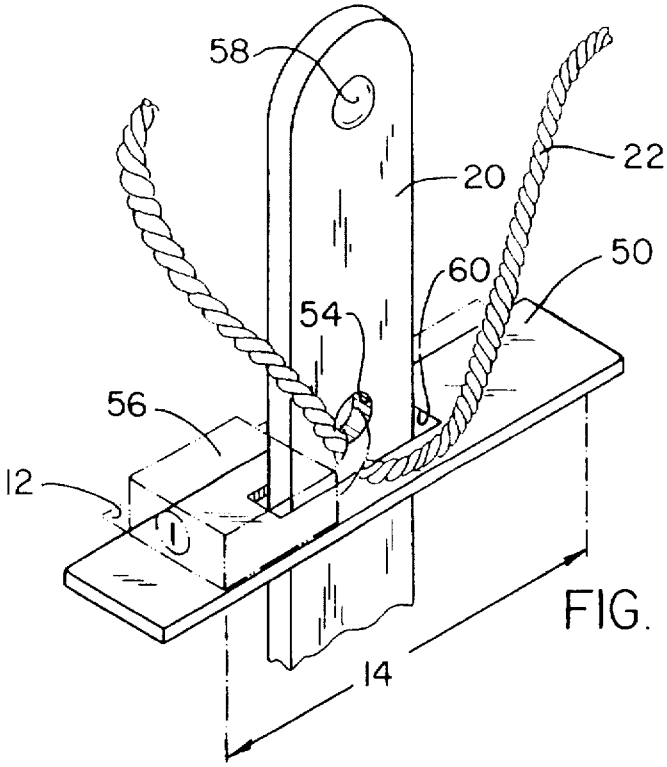
FIG. 2 is a perspective view of the top portion of the embodiment of the boat locking apparatus shown in FIG. 1 installed in a slot in a centerboard and affixed with a padlock to prevent removal of the apparatus from the boat.
Figure 3:
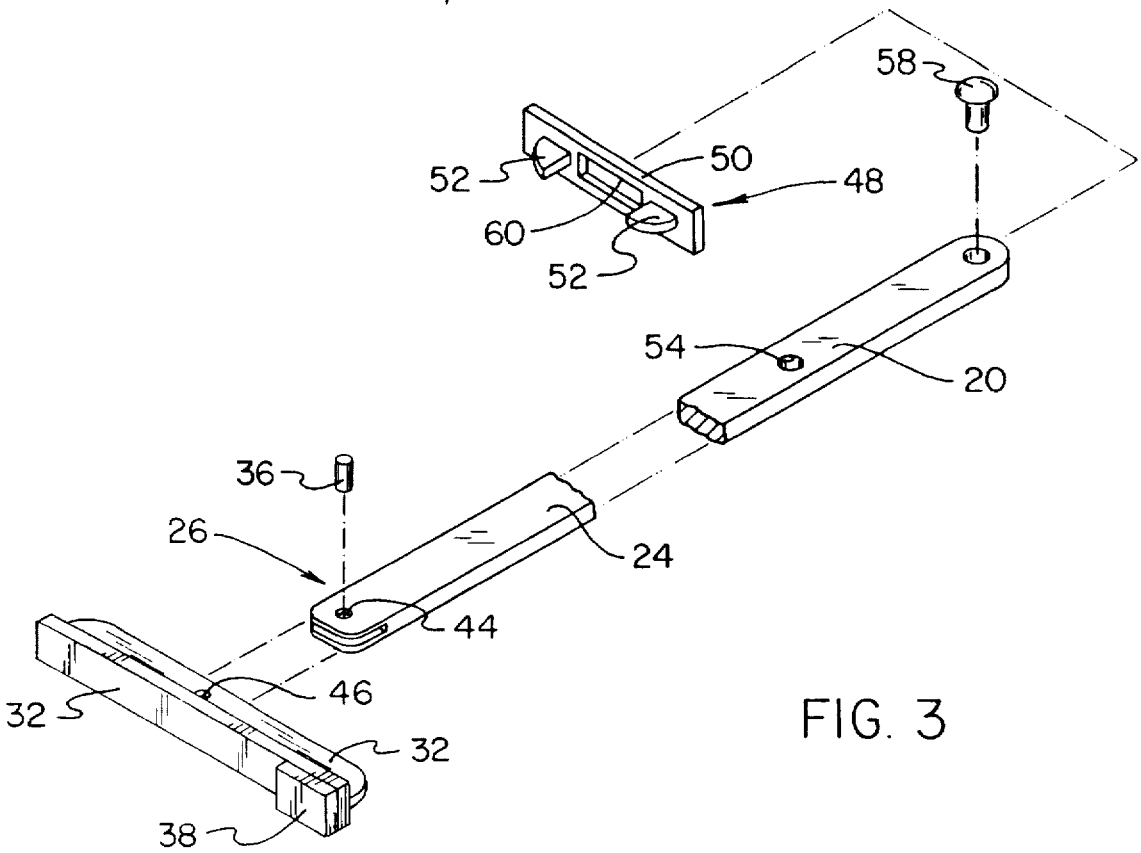
FIG. 3 is an exploded perspective view of the embodiment of invention shown in FIG. 1.

With reference to the drawings, a new and improved boat locking apparatus embodying the principles and concepts of the present invention will be described.

Turning to FIGS. 1–5, there is shown a first preferred embodiment of the boat locking apparatus of the invention generally designated by reference numeral 10. In its preferred form, boat locking apparatus 10 is provided for a boat that has a centerboard slot 12 which has a predetermined width 14 and a predetermined height 16. The boat locking apparatus 10 includes a lock-retaining assembly 18 which includes a first end portion 20 adapted for connecting with a flexible connector 22, which includes a mid-portion 24 extending distally from the first end portion 20, and which includes a second end portion 26 that is connected to the mid-portion 24. A predetermined distance 28 which includes the first end portion 20, the mid-portion 24, and the second end portion 26 of the lock-retaining assembly 18 is greater than the predetermined height 16 of the centerboard slot 12. The lock-retaining assembly 18 has a width 25 which is less than the width 14 of the centerboard slot 12. An extensible lock assembly 30 is connected to the second end portion 26 of the lock-retaining assembly 18. The extensible lock assembly 30 includes a pair of selectable extensible/retractable members 32 capable of being oriented in two selectable orientations, a retracted orientation in which the extensible/retractable members 32 are oriented along a longitudinal axis 34 extending along the lock-retaining assembly 18 such that the extensible/retractable members 32 extend transversely by a distance less than the width 14 of the centerboard slot 12 and an extended orientation in which the extensible/retractable members 32 are oriented transversely to the longitudinal axis 34 and extend transversely by a distance 35 greater than the width 14 of the centerboard slot 12.

The extensible lock assembly 30 includes an axle 36 which is connected to the second end portion 26 of the lock-retaining assembly 18. Extensible/retractable members 32 are connected to the axle 36, such that the extensible/retractable members 32 are capable of rotating around the axle 36 in moving from a retracted orientation to an extended orientation and vice versa. A ballast assembly 38 is connected to one of the extensible/retractable members 32 for urging the extensible/retractable members 32 to the retracted orientation from the extended orientation. The ballast assembly 38 can be comprised of a small metal weight attached to one of the extensible/retractable members 32.

The second end portion 26 of the lock-retaining assembly 18 includes an axle-holding assembly 40. The axle 36 and the extensible/retractable members 32 are supported by the axle-holding assembly 40. The axle 36 passes through a channel 44 in the axle-holding assembly 40 and a channel 46 between the extensible/retractable members 32. The extensible/retractable members 32 and the channel 46 are formed as a unified, one-piece structure.

A lock plate 48 is mounted on the first end portion 20 of the lock-retaining assembly 18. The lock plate 48 is capable of sliding up and down the first end portion 20 and is capable of engaging a top portion of the centerboard slot 12. The lock plate 48 includes a transverse portion 50 which straddles the first end portion 20 of the lock-retaining assembly 18 and a descending portion 52 which projects from the transverse portion 50 and which is adapted to enter a top portion of the centerboard slot 12. The transverse portion 50 of the lock plate 48 includes an aperture 60 which permits the first end portion 20 of the lock-retaining assembly 18 to pass through the transverse portion 50. The first end portion 20 of the lock-retaining assembly 18 includes a receiving aperture 54. The receiving aperture 54 is adapted to receive a shank of a padlock 56. The first end portion 20 of the lock-retaining assembly 18 includes a stop element 58 which prevents the lock plate 48 from sliding off of the first end portion 20.

Figure 4:
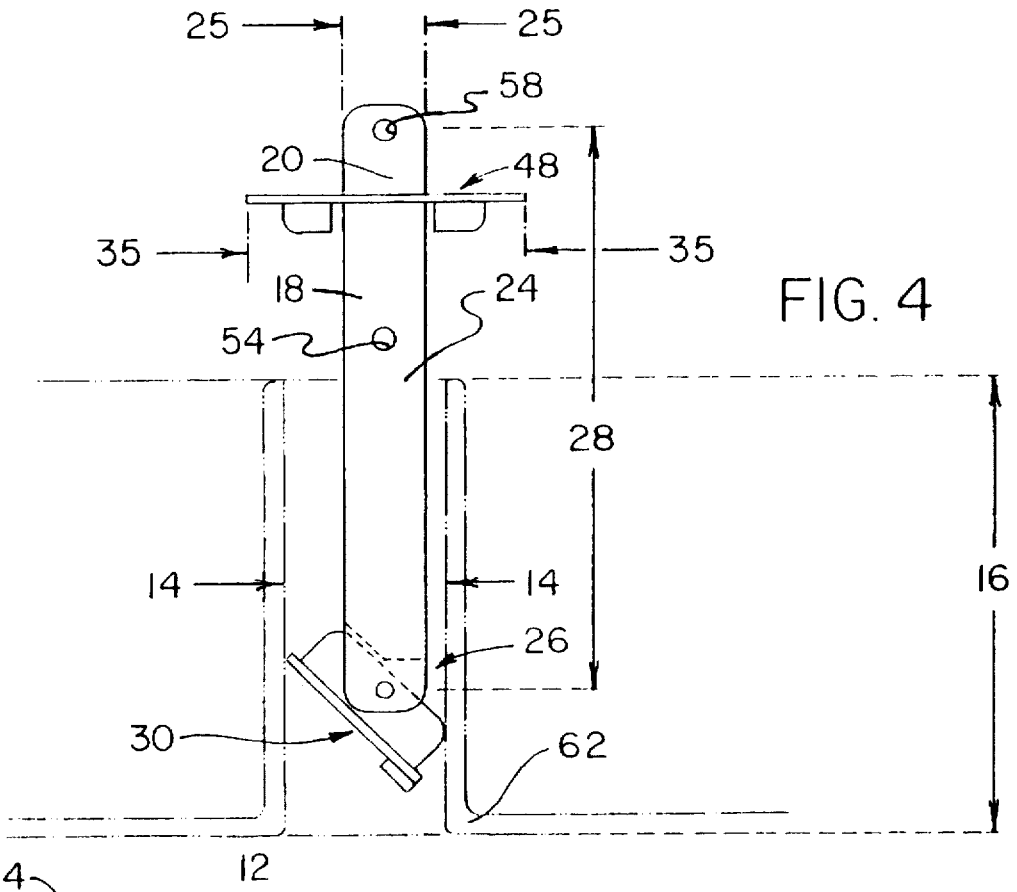
FIG. 4 is a front view of a modified version of the embodiment of the invention shown in FIG. 1 being installed in a slot of a dagger-type centerboard which is shown in cross-section.

In using the first embodiment of the boat locking apparatus 10 of the invention, the extensible/retractable members 32 are rotated around the axle 36 so that the extensible/retractable members 32 lie substantially along the longitudinal axis 34 and so that the ballast assembly 38 is located on the extensible/retractable member 32 positioned below the axle 36. The extensible lock assembly 30 and the second end portion 26 of the lock-retaining assembly 18 are lowered into the centerboard slot 12. The relatively narrow width 14 of the centerboard slot 12 retains the extensible/retractable members 32 in a substantially retracted (longitudinal) orientation as the boat locking apparatus 10 of the invention is lowered into the centerboard slot 12 as shown in FIG. 4.

Figure 5:
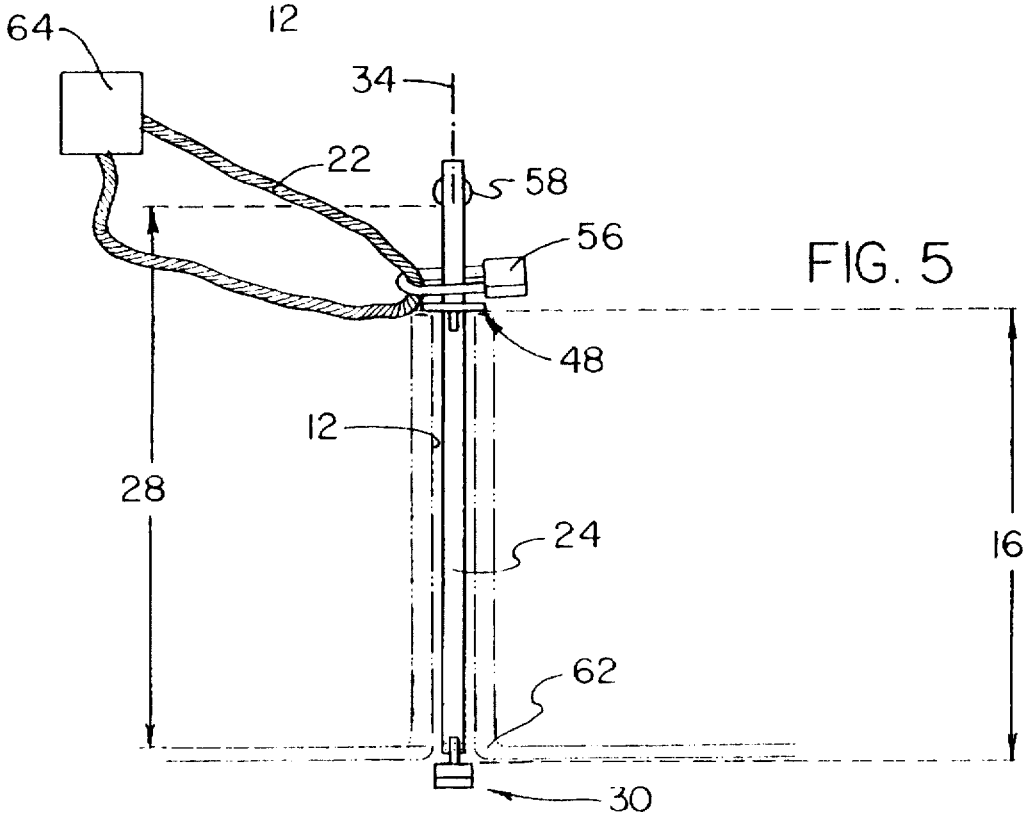
FIG. 5 is a front view of the embodiment of the invention shown in FIG. 4 already installed in the slot of the dagger-type centerboard.

When the extensible lock assembly 30 passes by the bottom most portion of the centerboard slot 12, the uppermost edge of the uppermost extensible/retractable member 32 is moved into contact with a bottom portion of the boat hull. Then the lock-retaining assembly 18 is pulled up, causing the uppermost edge of the uppermost extensible/retractable member 32 to catch against the bottom of the boat hull and causing the extensible/retractable members 32 to rotate around the axle 36 so that the extensible/retractable members 32 are in an extended (transverse) orientation. When the extensible/retractable members 32 are in the extended orientation, the transverse distance 35 of the extensible/retractable members 32 is greater than the width 14 of the centerboard slot 12, such that the extensible/retractable members 32 butt up against the hull 62 of the boat as shown in FIG. 5.

Then, the lock plate 48 is lowered along the first end portion 20 of the lock-retaining assembly 18 so that the lock plate 48 engages the top most portion of the centerboard slot 12. The shank of a padlock 56 is placed through the receiving aperture 54 on the first end portion 20 of the lock-retaining assembly 18, and a flexible connector 22 is threaded through the shank of the padlock 56 and attached to a fixed structure 64. In this way the boat is secured to the fixed structure 64 employing the flexible connector 22 and the boat locking apparatus 10 of the invention.

To remove the boat locking apparatus 10 of the invention from the boat, the padlock 56 is removed from the first end portion 20 of the lock-retaining assembly 18. The lock plate 48 is raised up along the first end portion 20. The first end portion 20 is further lowered into the centerboard slot 12. When the first end portion 20 of the lock-retaining assembly 18 has entered the centerboard slot 12 a sufficient distance, the extensible/retractable members 32 of the extensible lock assembly 30 are pushed clear of the hull 62 of the boat. Then the ballast assembly 38 is able to swing the extensible/retractable members 32 to another longitudinal position in which the ballast assembly 38 is on the lower most extensible/retractable member 32. When the extensible/retractable members 32 are in this longitudinal position, the boat locking apparatus 10 of the invention can be raised out of the centerboard slot 12.

Figure 6:
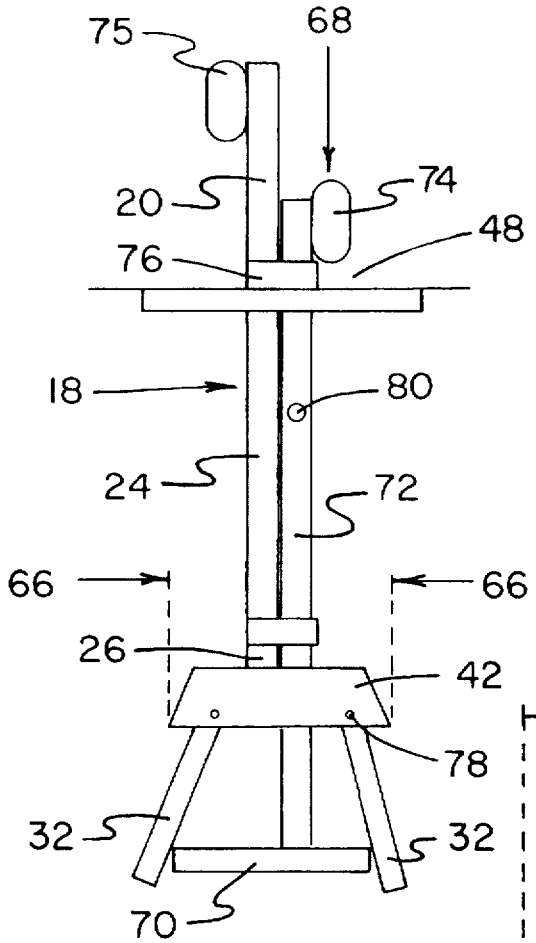
FIG. 6 is a side view of a second embodiment of the invention prior to installation in the slot for a centerboard.
Figure 7:
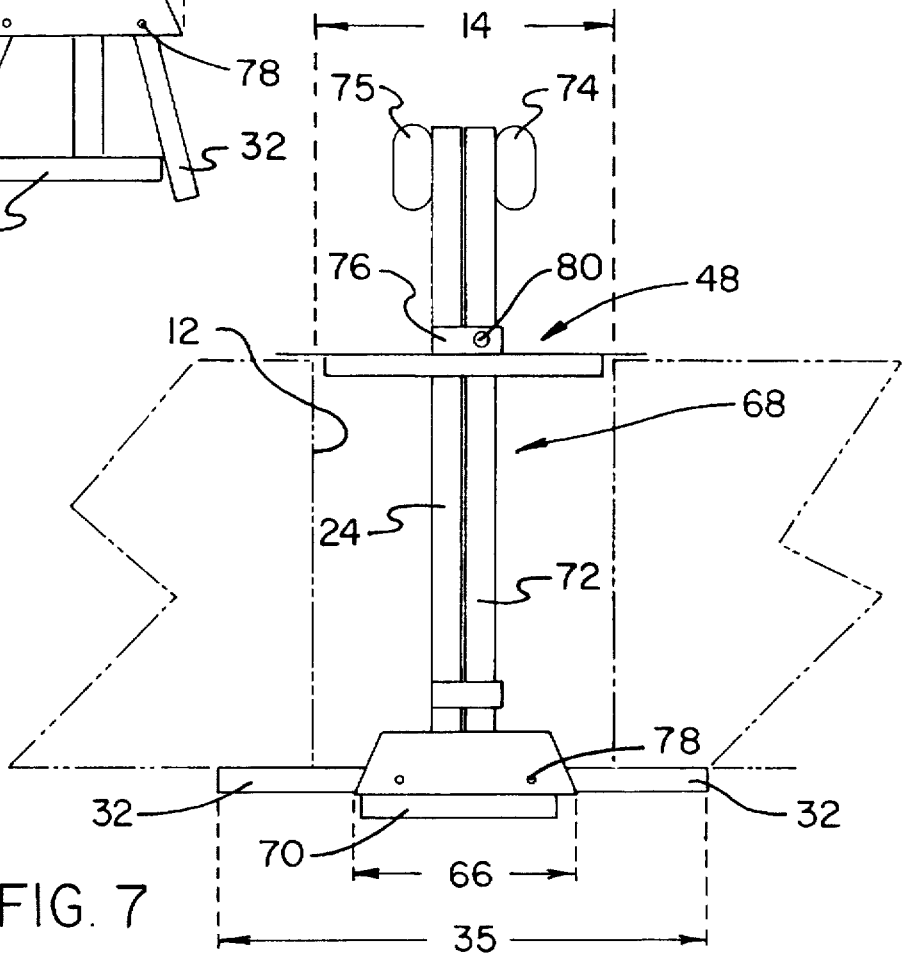
FIG. 7 is a side view of the embodiment of the invention shown in FIG. 6 after being installed in the slot for the centerboard.

Turning to FIGS. 6 and 7, a second embodiment of the invention is shown. Reference numerals are shown that correspond to like reference numerals that designate like elements shown in the other figures. In addition, the extensible lock assembly 30 includes a transverse member 42 which is connected to the second end portion 26 of the lock-retaining assembly 18. The transverse member 42 has a length 66 which is less that the width 14 of the centerboard slot 12. A pair of extensible/retractable members 32 is connected to respective ends of the transverse member 42.

An extensor assembly 68 is connected to the lock-retaining assembly 18 for selectively extending or retracting the extensible/retractable members 32. The extensor assembly 68 includes a spreader member 70 adapted to urge the extensible/retractable members 32 to an extended, transverse orientation. A shank member 72 is connected to the spreader member 70, and a handle 74 is connected to the shank member 72. A connector band 76 is used to position the extensor assembly 68 next to the lock-retaining assembly 18. The connector band 76 permits the shank member 72 of the extensor assembly 68 to slide against the mid-portion 24 of the lock-retaining assembly 18 when the handle 74 is operated, and the spreader member 70 is raised and lowered. When the spreader member 70 is in a lowered position, the extensible/retractable members 32 are in a retracted orientation as shown in FIG. 6.

The lock-retaining assembly 18 is also provided with a handle 75. To lower the spreader member 70 to the lowered position, the handle 75 is grasped in one hand, and the handle 74 is grasped in the other hand. The user pulls up on handle 75 and pushes down on handle 74 to lower the spreader member 70. When the spreader member 70 is raised, as shown in FIG. 7, the extensible/retractable members 32 are in an extended orientation, that is they are oriented transversely. To raise the spreader member 70, the user pulls up on handle 74 and pushes down on handle 75. In their transverse orientation, the overall transverse length of the extensible/retractable members 32 is distance 35 which is greater than the width 14 of the centerboard slot 12 such that the extensible/retractable members 32 lock against the bottom of the hull 62 of the boat. The extensible/retractable members 32 are connected to the spreader member 70 by pivoted connections 78. The shank member 72 can includes a receiving aperture 80 for receiving a shank of a padlock 56.

The extensible/retractable members 32 are made from materials that preclude or inhibit scratching of the hull 62 of the boat. Moreover, the extensible/retractable members 32 can be made from or coated with materials which provide a good seal against the hull 62 of the boat when the boat locking apparatus 10 of the invention is installed on a boat.

Figures 8, 9:
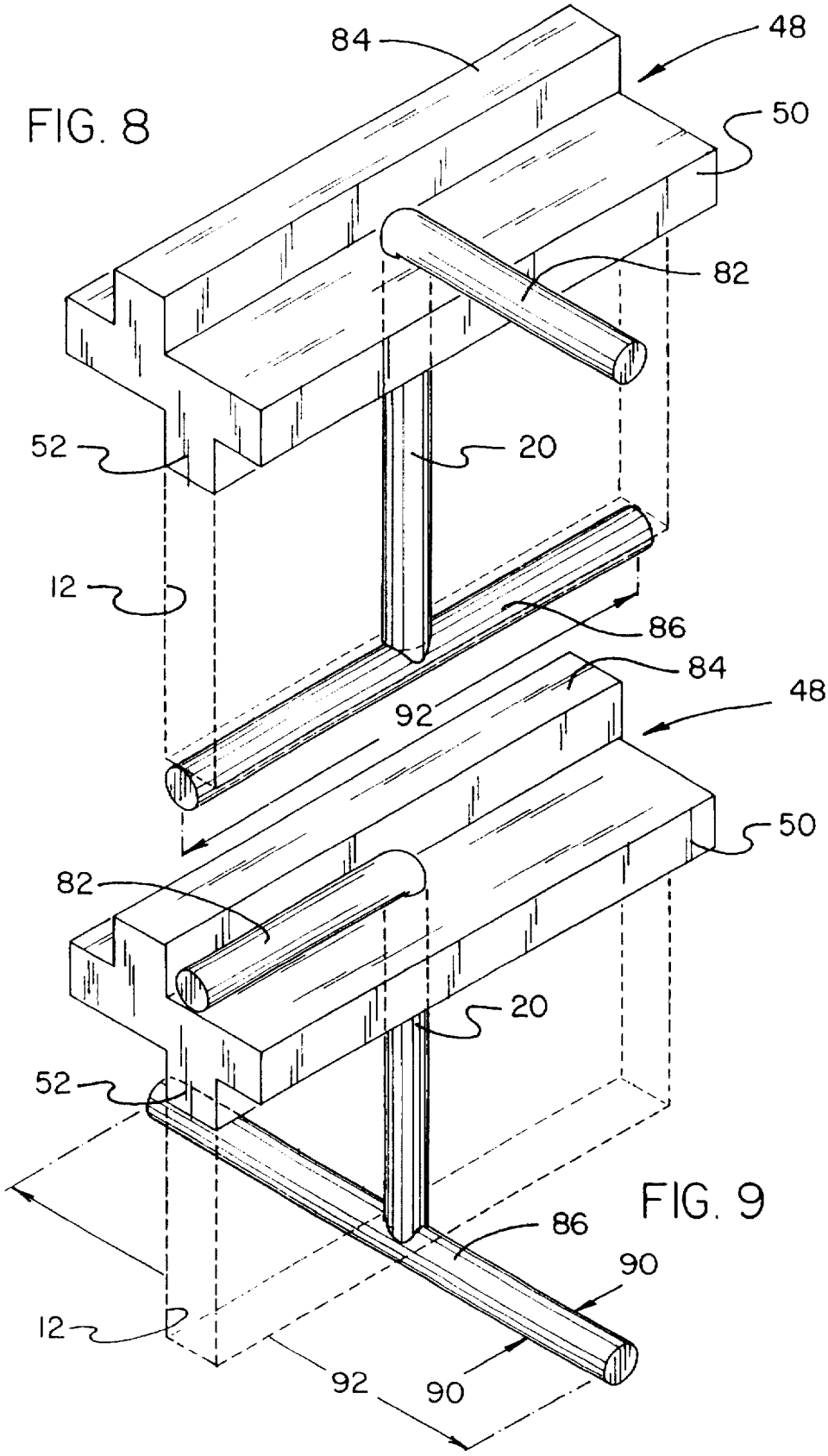
FIG. 8 is a side view of a third embodiment of the invention prior to installation in the slot for a centerboard.
FIG. 9 is a side view of the embodiment of the invention shown in FIG. 8 after being installed in the slot for the centerboard.

With respect to the third embodiment of the invention, with reference to FIGS. 8–9, reference numerals are shown that correspond to like reference numerals that designate like elements shown in the other figures. In addition, the boat locking apparatus 10 further includes a crank member 82 which is connected to the first end portion 20 of the lock-retaining assembly 18. A lock plate 48 is mounted on the first end portion 20 of the lock-retaining assembly 18. The lock plate 48 is capable of sliding up and down the first end portion 20 and is capable of engaging a top portion of the centerboard slot 12. The lock plate 48 includes a transverse portion 50 which straddles the first end portion 20 of the lock-retaining assembly 18. A descending portion 52 projects down from the transverse portion 50 and is adapted to enter a top portion of the centerboard slot 12.

An ascending portion 84 projects upward from the transverse portion 50 of the lock plate 48. The transverse lock assembly includes a transverse member 86 which is connected to the second end portion 26 of the lock-retaining assembly 18. The transverse member 86 includes a width 90 which is less than the predetermined width 14 of the centerboard slot 12 and includes a length 92 which is greater than the predetermined width 14 of the centerboard slot 12. The transverse member 86 and the crank member 82 are located in parallel planes spaced apart from each other by the lock-retaining assembly 18 and are oriented at right angles to each other.

In use, to install the third embodiment of the invention, the transverse member 86 is oriented so that its relatively narrow width 90 can be passed through the centerboard slot 12 of predetermined width 14. Once the transverse member 86 clears the bottom of the centerboard slot 12, then the crank member 82 is rotated around the lock-retaining assembly 18. In so doing, the transverse member 86 is rotated so that its length 92 extends across the bottom of the centerboard slot 12. In this orientation, the transverse member 86 prevents the boat locking apparatus 10 of the invention from is removed from the boat. In addition, in this locking orientation, the crank member 82 can be placed up against the ascending portion 84 of the lock plate 48 and secured thereto. More specifically, a channel in the crank member 82 can be placed in registration with a complementary channel in the ascending portion 84 of the lock plate 48. The flexible connector 22 can be threaded through the two registered apertures to secure the crank member 82 to the lock plate 48 and to maintain the transverse member 86 in its locking position.

Generally, the components of the boat locking apparatus of the invention can be made from inexpensive and durable plastic and metal. The extensible/retractable members 32 can have rubberized coatings to prevent the hull 62 of the boat from being scratched.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved boat locking apparatus that is low in cost, relatively simple in design and operation, and which may advantageously be used to secure a boat to a fixed structure without relying upon a fitting secured to the boat with screws. With the invention, a boat locking apparatus is provided which secures a boat to a fixed structure by employing a slot in the boat that is used for receiving a centerboard. With the invention, a boat locking apparatus is provided which can be installed on a boat hull from either the top side of the bottom side of the hull. With the invention, a boat locking apparatus is provided which is used for securing a boat to a fixed structure. With the invention, a boat locking apparatus is provided which is simple in structure and operation for securing a boat to a fixed structure. With the invention, a boat locking apparatus is provided which permits the device to be installed in a centerboard slot from one side of the boat hull and permits the boat to be secured to a fixed structure from the same side of the boat hull. With the invention, a boat locking apparatus is provided which precludes the necessity of either placing the boat on its side or turning the boat from one side to an opposite side for installation of the device.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. In combination a boat with a centerboard slot and a locking apparatus therefore, said centerboard slot having a predetermined width, a predetermined length, and a predetermined height, said locking apparatus comprising:

a lock-retaining assembly which includes a first end portion and a second end portion extending distally from said first end portion, wherein a predetermined distance including said first end portion and said second end portion of said lock-retaining assembly is greater than the predetermined height of the centerboard slot, and wherein said lock-retaining assembly has a width which is less than the width of the centerboard slot, and a transverse lock assembly connected to said second end portion of said lock-retaining assembly, said transverse lock assembly adapted to be selectively oriented in a non-locking first orientation in which said transverse lock assembly is contained within the predetermined width of the centerboard slot and a second locking orientation in which said transverse lock assembly cannot be contained within the predetermined width of the centerboard slot, a crank member connected to said first end portion of said lock-retaining assembly and a lock plate mounted on said first end portion of said lock-retaining assembly, wherein said lock plate is adapted for sliding up and down on said first end portion and is capable of engaging a top portion of the centerboard slot, wherein said lock plate includes a transverse portion which straddles said first end portion of said lock-retaining assembly, a descending portion which projects from said transverse portion and which is adapted to enter a top portion of the centerboard slot, and an ascending portion which projects upward from said transverse portion, said ascending portion being laterally displaced on said transverse portion with respect to said descending portion, wherein said transverse lock assembly includes a transverse member connected to said second end portion of said lock-retaining assembly, wherein said transverse member includes a width which is less than the predetermined width of the centerboard slot and includes a length which is greater than the predetermined width of the centerboard slot, and wherein said transverse member and said crank member are located in parallel planes spaced apart from each other by said lock-retaining assembly and are oriented at right angles to each other, and wherein said crank member is adapted to extend angularly with respect to said ascending portion when said transverse portion descending portion is received within the top portion of said centerboard slot and said crank member is adapted to extend substantially parallel to said ascending portion when said transverse portion descending portion is received within the top portion of said centerboard slot and said transverse locking assembly is selectively oriented in said locking orientation with said transverse member extending angularly with respect to said centerboard slot.

* * * * *